US006348079B1

(12) United States Patent
Choo

(10) Patent No.: US 6,348,079 B1
(45) Date of Patent: Feb. 19, 2002

(54) SINTERED ALLOY HAVING A WEAR RESISTANCE FOR A VALVE SEAT AND METHOD OF PRODUCING THE SAME

(75) Inventor: Kwang Myung Choo, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/721,939

(22) Filed: Nov. 27, 2000

(30) Foreign Application Priority Data

Mar. 31, 2000 (KR) ..... 2000-16888

(51) Int. Cl.[7] ..... B22F 3/24

(52) U.S. Cl. ..... 75/243; 75/246; 419/26; 419/27; 419/29

(58) Field of Search ..... 75/243, 246; 419/26, 419/27, 29

(56) References Cited

U.S. PATENT DOCUMENTS 4,363,662 A * 12/1982 Takahashi et al. ..... 75/243
4,964,908 A * 10/1990 Greetham ..... 75/241
4,966,626 A * 10/1990 Fujiki et al. ..... 75/238
4,970,049 A * 11/1990 Baker et al. ..... 419/11
4,976,916 A * 12/1990 Shimomura ..... 419/25
5,221,321 A * 6/1993 Lim ..... 75/246
5,312,475 A * 5/1994 Purnell et al. ..... 75/231
6,251,157 B1 * 6/2001 Aoki et al. ..... 75/231

* cited by examiner

*Primary Examiner*—Ngoclan Mai

(57) ABSTRACT

The present invention relates to s a sintered alloy having an excellent wear resistance for a valve seat and a method of producing the same. More particularly, the present invention relates to the sintered alloy having an excellent wear resistance for a valve seat, which is produced by a sub-zero treatment for a metal powder comprising Fe(iron) as a main component, C(carbon), Si (silicon), Cr(chromium), Mo(molybdenum), Co(cobalt), Mn(Manganese), Pb(lead), V(vanadium) and W(tungsten) so that amount of metallic particles separated from a base matrix decreases and a size of the separated metallic particle becomes small when an abrasion of the sintered alloy is in proceed, thereupon a wear resistance and an impact resistance are improved and a self-lubricity and a machinability are enhanced, and a method of producing the same.

2 Claims, No Drawings

SINTERED ALLOY HAVING A WEAR RESISTANCE FOR A VALVE SEAT AND METHOD OF PRODUCING THE SAME

BACKGROUND OF THE INVENTION

1. Field of the invention

The present invention relates to a sintered alloy having an excellent wear resistance for a valve seat and a method of producing the same. More particularly, the present invention relates to a sintered alloy having an excellent wear resistance for a valve seat, which is produced by a sub-zero treatment for a metal powder containing Fe(iron) as a main component, C(carbon), Si (silicon), Cr(chromium), Mo(molybdenum), Co(cobalt), Mn(manganese), Pb(lead), V(vanadium) and W(tungsten) so that amount of metallic particles separated from a base matrix decreases and a size of the separated metallic particle becomes small when an abrasion of the sintered alloy is in proceed, thereupon a wear resistance and impact resistance are improved and a self-lubricity and a machinability is enhanced, and a method of producing the same.

2. Description of the Prior Art

A conventional sintered alloy having a wear resistance used for a valve seat comprises Fe as a main component, C of from 0.4 to 1.2% by weight, Si of from 0.1 to 1.0% by weight, Cr of from 0.5 to 2.0% by weight, Mo of from 6.0 to 10.0% by weight, Co of from 6.0 to 15.0% by weight and Pb of from 0.4 to 1.2% by weight.

The processes as follow produce such a sintered alloy having an excellent wear resistance used for a valve seat.

First of all, a metal powder as above except Pb is mixed and then a surface pressure of from 4 to 8 ton/cm$^2$ is applied to the mixed metal powder. Under a reducing atmosphere, a preliminary sinter process is performed at a temperature of from 750 to 800° C. for 40 minutes and then a forging process is performed at surface pressure of 7 to 10 ton/cm$^2$. Thereafter, a main sinter process is performed at a temperature of from 1,110 to 1,140° C. for from 30 to 40 minutes under hydrogen atmosphere and then Pb is impregnated at a temperature of from 400 to 450° C. for from 10 to 30 minutes so as to give a self-lubricity, and then a barrel process is performed at same temperature for from 80 to 110 minutes, the sintered alloy having an excellent wear resistance for a valve seat is produced.

However, the sintered allov having components and content as described above has a microstructure characteristic in which giant metal particles are dispersed in the base matrix. Such giant metal particles cause a crack when an external impact is applied so that an impact resistance is deteriorated. Therefore, the wear resistance will be deteriorated so that the metal particles are fallen away from the abrasive surface. Further, there is a problem that a compressed gas in a cylinder is leaked, therefore, there is an urgent need to improve such problems.

SUMMARY OF THE INVENTION

As described above, a productivity for producing a conventional sintered alloy having a wear resistance for a valve seat is decreased due to a great deal of process and a impact resistance and a wear resistance are deteriorated by giant particles dispersed within a base matrix. And further a leakage of a compressed air can be occurred.

Therefore, it is an object of the present invention to provide a sintered alloy having an improved wear resistance and a machinability for a valve seat by containing Fe(iron) as a main component, C(carbon), Cr(chromium) Mo(molybdenuni), V(vanadium), W(tungsten), Si(silicon), Co(cobalt), Mn(manganese) and Pb(lead) and to provide a method of producing the same.

For fuller understanding of the nature and objects of the invention, reference should be had to the following detailed description.

DETAILED DESCRIPTION OF THE INVENTION

The present invention is characterized by a sintered alloy having a wear resistance for a valve seat comprising Fe(iron) as a main component, C(carbon) of from 0.8 to 1.2% by weight, Cr(chromium) of from 2.0 to 4.0% by weight, Mo(molybdenum) of from 2.0 to 4.0% by weight, V(vanadium) of from 2.0 to 4.0% by weight, W(tungsten) of from 7.0 to 10.0% by weight, Si(silicon) of from 0.2 to 0.6% by weight, Co(cobalt) of from 3.0 to 5.0% by weight, Mn(manganese) of from 0.2 to 0.5% by weight, Pb(lead) of from 10.0 to 15.0% by weight.

The present invention is also characterized by a method thereof comprising;

- the first step of mixing Fe as a main component, C of from 0.8 to 1.2% by weight, Cr of from 2.0 to 4.0% by weight, Mo of from 2.0 to 4.0% by weight, V of from 2.0 to 4.0% by weight, T of from 7.0 to 10.0% by weight, Si of from 0.2 to 0.6% by weight, Co of from 3.0 to 5.0% by weight, Mn of from 0.2 to 0.5% by weight and applying a surface pressure of from 5 to 8 ton/cm$^2$;
- the second step of sintering at a temperature of from 1140 to 1180° C. and then cooling by air;
- the third step of performing the sub-zero treatment at a temperature of from −200 to −160° C.;
- the fourth step of impregnating Pb at a temperature of from 450 to 550° C.; and
- the fifth step of performing the barrel process at the same temperature.

The present invention is described in detail hereunder.

In the present invention, Fe is a main component and a content of each alloy steel component is limited in order to improve a wear resistance and machinability. In particular, a metal powder of a high speed steel such as C, Cr, Mo, V and W is used to increase a cutting ability and improve a surface property.

First, Fe as a main component, C of from 0.8 to 1.2% by weight, Cr of from 2.0 to 4.0% by weight, Mo of from 2.0 to 4.0% by weight, V of from 2.0 to 4.0% by weight, W of from 7.0 to 10.0% by weight, Si of from 0.2 to 0.6% by weight, Co of from 3.0 to 5.0% by weight, Mn of from 0.2 to 0.5% by weight are mixed and then a surface pressure of from 5 to 8 ton/cm$^2$ is applied;

A mechanical property of the sintered alloy varies significantly with a content of C. A content of C is used in the range of from 0.8 to 1.2% by weight against the total weight of the composition of the sintered alloy. If the content of C is less than 0.8% by weight, a strength and hardness are insufficient. In contrast, if the content of C is more than 1.2% by weight, a tensile strength and a hardness are decreased, therefore it is not desirable.

Cr used in the present invention is added in order to increase a wear resistance and a cutting ability. Cr is used in the range of from 1.0 to 2.5% by weight against the total weight of the composition of the sintered alloy. If the content of Cr is less than 1.0% by weight, an improvement of the wear resistance and the cutting ability cannot be obtained.

On the other hand, if the content of Cr is more than 2.5% by weight, a physical property is not increased any more.

Mo used in the present invention is added in order to increase a cutting ability, a tensile strength at a high temperature and a hardness. Mo is used in the range of from 0.1 to 0.3% by weight against the total weight of the composition of the sintered alloy. If the content of Mo is less or more than the above range, strength and hardness are not increased.

V used in the present invention is added in order to adjust a grain. V is used in the range of from 2.0 to 4.0% by weight against the total weight of the composition of the sintered alloy. If the content of V is less than 2.0% by weight, giant grain that causes a crack is produced, therefore, it is not desirable.

W used in the present invention is added in order to increase a tensile strength at a high temperature and hardness. W of the invention is used in the range of from 7.0 to 10.0% by weight against the total weight of the composition of the sintered alloy. If the content of W is less than 7.0% by weight, a small quantity of carbide is formed so that a wear resistance becomes lowered. If the content of W is more than 10.0% by weight, a physical property is not increased any more.

Also, Si used in the present invention is added as a de-oxidizer. Si prevents grain carbides from precipitating from grain boundaries during manufacturing process and, at same time, Si plays a role for decreasing a grain oxide layer. On the other hand, there is a trend that Si makes segregation in the alloy, and also becomes a silicon oxide which exists in the steel and forms a grain oxide layer so that a content of Si has to be limited. In the present invention, Si is used in the range of from 0.2 to 0.6% by weight against the total weight of the composition of the sintered alloy. If the content of Si is less than 0.2% by weight, an effect of the de-oxidizer cannot be obtained enough. If the content of Si is more than 0.6% by weight, it is not desirable since a great deal of segregation is formed in the alloy.

Co used in the present invention is added in order to increase the strength, and Co is used in the range of from 3.0 to 5.0% by weight against the total weight of the composition of the sintered alloy.

Mn used in the present invention is added in order to combine with a very small amount S(surfur) to obtain MnS. Mn is used in the range of from 0.2 to 0.5% by weight against the total weight of the composition of the sintered alloy. If the content of Mn is less than 0.2% by weight, it is not desirable since MnS is formed and it is difficult to have a self-lubricity.

In the second step, the mixed metal powder is sintered at a temperature of from 1,140 to 1,180° C. for 30 to 50 minutes and then cooled by air. If the sinter process is performed at lower than 1,140° C., the powder particles are not dispersed uniformly so that the base matrix becomes weaken. If the sinter process is performed at higher than 1,180° C., it is not desirable since the grain increases in size so that a mechanical property is deteriorated.

In the third step, the sub-zero treatment for the sintered alloy is performed at a temperature of from −200 to −160° C. for 5 to 20 minutes. This sub-zero treatment makes a transformation of the alloy proceed to reduce a residual austenite so that a mechanical property of the alloy can be improved.

In the present invention, this sub-zero treatment provides not only shortening the prior preliminary and main sinter processes for the sintered alloy and but also superior physical property.

In the fourth and fifth steps, Pb is impregnated with the sub-zero treated alloy at a temperature of from 450 to 550° C. for 30 to 50 minutes and then the barrel process is performed at the same temperature for 80 to 100 minutes.

Especially, Pb provides the self-lubricity and thus, it is possible to use for dried atmosphere fuel. Pb of the present invention is used in the range of from 10.0 to 15.0% by weight against the total weight of the composition of the sintered alloy. If the content of Pb is less than 10.0% by weight, a great deal of pores is created. While if the content of Pb is more than 15.0% by weight, it is not desirable since surplus Pb is precipitated from the surface after impregnating.

The sintered allov having an excellent wear resistance for the seat valve produced through the processes described in the present invention provides a surface characteristic in which micro spherical particles are dispersed uniformly in the base matrix with the high speed steel metallic powder, as well as an excellent abrasion resistance because a size of the separated carbide particle is very small when an abrasion of alloy is in proceed. And, the alloy of the present invention has a continuation property since dispersed metallic powders are extremely fine and the powders having a lower hardness are mixed so that the machinability can be enhanced during manufacturing process. Also, it can be also used for dried atmosphere fuel due to the self-lubricity obtained by the impregnation of Pb.

The present invention will be described in more detail taken in conjunction with the example, however, the present is not limited by the example.

EXAMPLE AND COMPARATIVE EXAMPLE

The sintered alloy for the valve seat is produced by mixing each component and each content thereof as shown in Table 1. The mixed powder was formed under a pressure of 7 ton/cm$^2$ and then was sintered at 1,170° C. for 40 minutes. Thereafter, the sub-zero treatment was performed at a temperature of −180° C. for 10 minutes and a tempering was performed at a temperature of 500° C. for 40 minutes after impregnating Pb. Then, the barrel process is performed to give the desired sintered alloy. The sintered alloy of Comparative example was obtained by the same procedure of Example except skipping the sub-zero treatment.

An amount abrasion of the sintered alloy produced by Example and comparative example having each component and each content as shown in Table 1, respectively, is measured and a result is shown in Table 1.

[Method for Testing]

1. Amount of abrasion (mm): Test was performed by a simulation Rig tester under conditions as below:

The number of revolutions of CAM: 1,500 rpm

Temperature: 400° C.

Time: 15 hours

Used fuel: LPG.

TABLE 1

| | Example | Comparative Example |
|---|---|---|
| Composition (% by weight) | | |
| C | 1 | 1 |
| Cr | 3 | 1 |
| Mo | 3 | 8 |

TABLE 1-continued

| | Example | Comparative Example |
|---|---|---|
| V | 3 | — |
| W | 8.5 | — |
| Si | 0.4 | 0.5 |
| Co | 4 | 10 |
| Mn | 0.3 | — |
| Pb | 12 | 12 |
| Cu | — | 1.2 |
| Fe | Balance | Balance |
| Amount of abrasion (mm) | 0.218 | 0.338 |

Compared with the comparative example, an amount of abrasion of the sintered alloy according to the example of the present invention is reduced by about 15% as shown in Table 1.

As described above, the sintered alloy produced by the sub-zero treatment according to the present invention provides an excellent wear resistance and thus it can be used for the dried atmosphere fuel.

What is claimed is:

1. A sintered alloy having an excellent wear resistance for a valve seat comprising Fe (iron) as a main component, C(carbon) of from 0.8 to 1.2% by weight, Cr(chromium) of from 2.0 to 4.0% by weight, Mo(molybdenum) of from 2.0 to 4.0% by weight, V(vanadium) of from 2.0 to 4.0% by weight, W(tungsten) of from 7.0 to 10.0% by weight, Si(silicon) of from 0.2 to 0.6% by weight, Co(cobalt) of from 3.0 to 5.0% by weight, Mn(manganese) of from 0.2 to 0.5% by weight, Pb(lead) of from 10.0 to 15.0% by weight.

2. A method for producing the sintered alloy having an excellent wear resistance for a valve comprising;

the first step of mixing Fe as a main component, C of from 0.8 to 1.2% by weight, Cr of from 2.0 to 4.0% by weight, Mo of from 2.0 to 4.0% by weight, V of from 2.0 to 4.0% by weight, W of from 7.0 to 10.0% by weight, Si of from 0.2 to 0.6% by weight, Co of from 3.0 to 5.0% by weight, Mn of from 0.2 to 0.5% by weight and applying a surface pressure of from 5 to 8 ton/cm$^2$;

the second step of sintering at a temperature of from 1,140 to 1,180 degree Celsius and then cooling by air;

the third step of performing sub-zero treatment at a temperature of from −200 to −180° C.;

the fourth step of impregnating Pb at a temperature of from 450 to 550° C.; and the fifth step of performing barrel process at the same temperature after completing the fourth step.

* * * * *